US006830430B2

(12) United States Patent
Lien

(10) Patent No.: US 6,830,430 B2
(45) Date of Patent: Dec. 14, 2004

(54) FAN WITH A SEPARABLE FLYING DISC

(76) Inventor: Jack Lien, 1F, No. 30, Yanji St., Kaohsiung (TW)

( * ) Notice: Subject to any disclaimer, the term of this patent is extended or adjusted under 35 U.S.C. 154(b) by 0 days.

(21) Appl. No.: 10/325,983

(22) Filed: Dec. 23, 2002

(65) Prior Publication Data

US 2004/0120818 A1 Jun. 24, 2004

(51) Int. Cl.[7] ..... A45B 27/00; A63H 27/00

(52) U.S. Cl. ..... 416/70 A; 416/142; 416/146 R; 446/46; 446/71; 446/487

(58) Field of Search ..... 416/62, 63, 69, 416/70 R, 70 A, 71, 72, 73, 142, 146 R; 446/46, 48, 71, 487

(56) References Cited

U.S. PATENT DOCUMENTS 1,126,797 A * 2/1915 Lichter ..... 416/70 A
2,264,505 A * 12/1941 Bittson ..... 416/72
2,371,792 A * 3/1945 Bernstein ..... 416/72
4,911,611 A * 3/1990 Moore ..... 416/70 A
5,975,849 A * 11/1999 Yang ..... 416/70 A

FOREIGN PATENT DOCUMENTS

IT 360642 * 7/1938 ..... 416/72

* cited by examiner

*Primary Examiner*—Edward K. Look
*Assistant Examiner*—Richard A. Edgar
(74) *Attorney, Agent, or Firm*—Birch, Stewart, Kolach & Birch, LLP

(57) ABSTRACT

A Frisbee™ fan comprises a fan body made from a fabric bordered by a flexible strip on the peripheral rim thereof and a folding plate clamping the fan body for generating a strong air flow. The fan body may be printed with a selected pattern. The fan body may be separated from the folding plate to become a Frisbee™ for recreational use. The flexible strip allows the fan body be twisted and folded to a smaller size and be encased in the folding plate to facilitate carrying and storing.

13 Claims, 13 Drawing Sheets

FAN WITH A SEPARABLE FLYING DISC

FIELD OF THE INVENTION

The present invention relates to a fan with a separable flying disc and particularly a fan that also provides the recreational function of a Frisbee™.

BACKGROUND OF THE INVENTION

The commonly used fans have a round body and a handle fixedly fastened together. They usually have a bulky size and are difficult to store. To remedy this problem, some producers have developed fans with a movable handle that is foldable. While the foldable handle overcomes the storing problem, it cannot be anchored on the fan body and is not effective for generating airflow. Moreover, the conventional fans serve only the function of the fan, thus have limited value.

SUMMARY OF THE INVENTION

In view of the aforesaid disadvantages, the primary object of the invention is to provide a fan with a separable flying disc that provides dual functions of the fan and the Frisbee™ or flying disc. The novel fan thus made offers more added value and has a greater appeal to consumers.

The fan according to the invention includes a fan body and folding plate. The fan body is made from a fabric having a flexible strip border on the peripheral rim. The folding plate is fastened to a tangent side of the peripheral rim of the fan body to form a force applying zone to enable a user's hand to grasp and wave the fan body. When the folding plate is grasped by the hand, it is depressed to contact the fan body flatly, thus the force applying area is expanded from point contact to surface contact. Waving force applying on the fan is more effective. In addition, the flexible strip is foldable and allows the fan body be twisted and folded to a smaller size and encased in the folding plate to facilitate storing. Moreover, the fan body and the folding plate may be separated to become two independent items. The separated fan body may be used as a Frisbee™ to serve recreational function.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
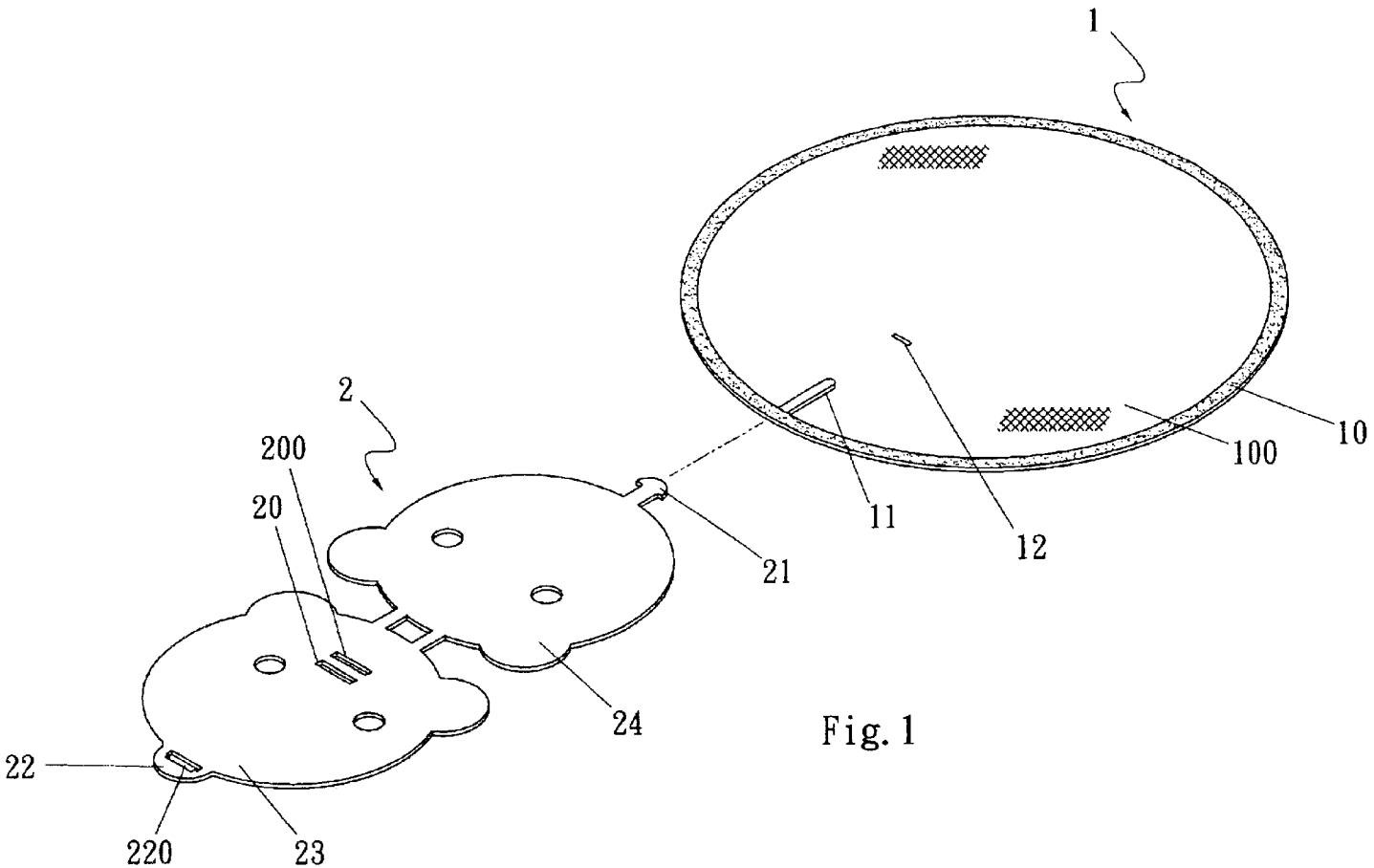
FIG. 1 is an exploded view of the invention.
Figure 2:
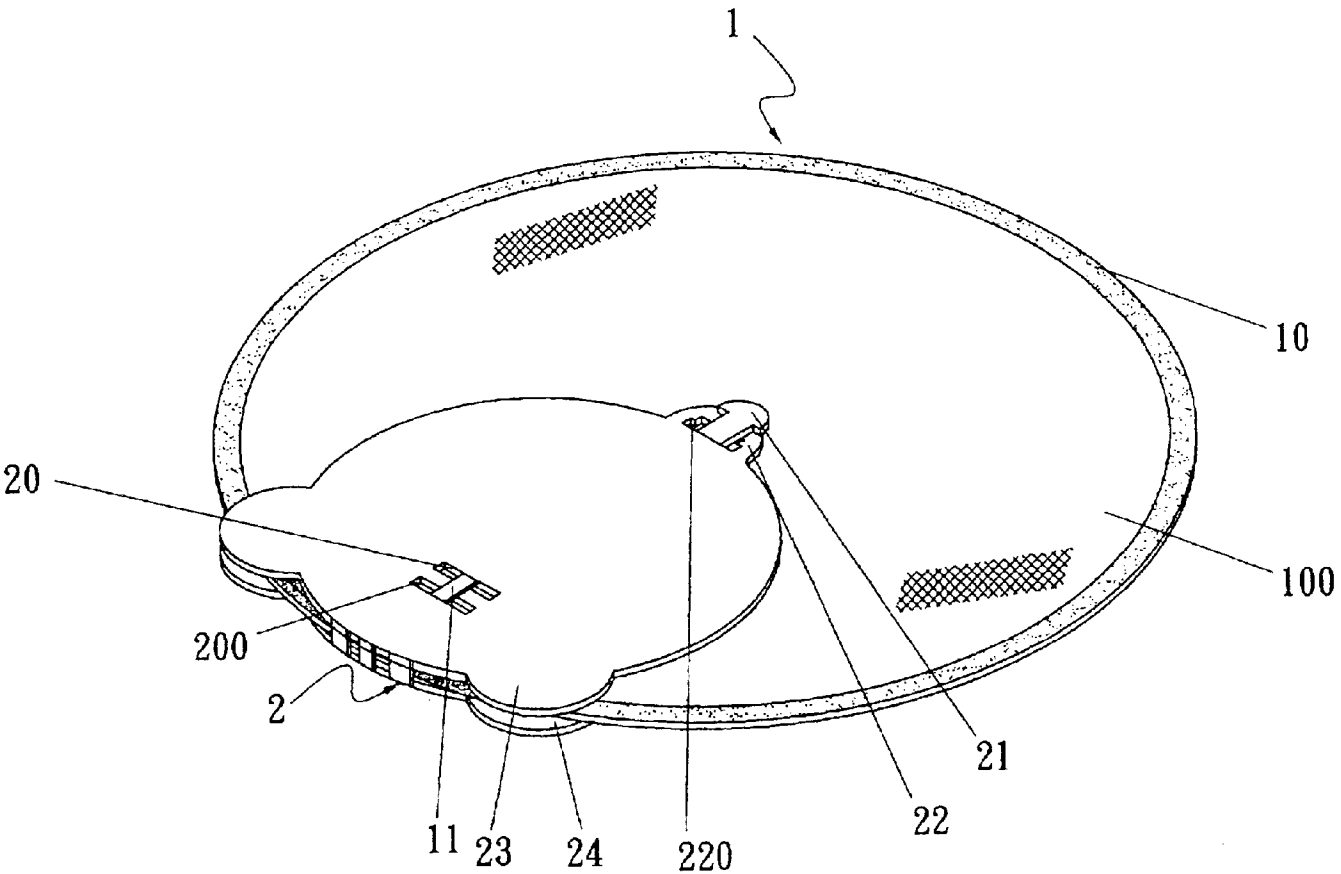
FIG. 2 is a perspective view of the invention.

Referring to FIG. 1, the invention includes a fan body 1 and a folding plate 2. The fan body 1 is made from a fabric 100 bordered by a flexible strip 10 on the peripheral rim. The fan body 1 may be printed with patterns. The fan body 1 has a coupling blade 11 extending from a tangent side of the perimeter thereof and an anchor hole 12 formed at a desired location. The folding plate 2 is made from paper and includes a first plate 23 and a second plate 24 formed in a selected pattern and connected together. The first plate 23 has a top end with a latch member 22 formed thereon. The latch member 22 has a latch hole 220 of a selected width. The first plate 23 further has two coupling holes 20 and 200 formed on selected locations. The second plate 24 has a top end with a latch stem 21 located thereon to engage with the latch member 22. The latch stem 21 has a wider front end.

Figure 4:
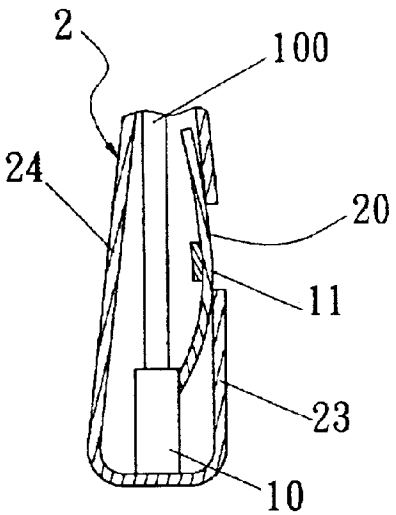
FIG. 4 is a fragmentary sectional view of the invention.
Figure 3:
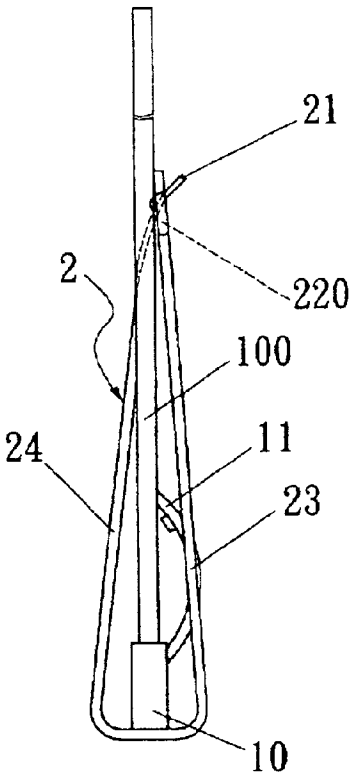
FIG. 3 is a side view of the invention.
Figure 5:
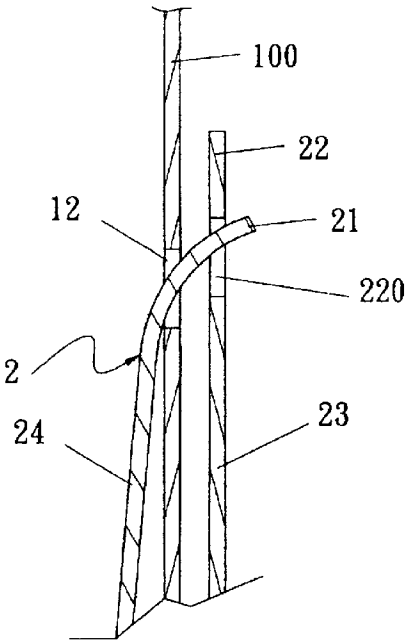
FIG. 5 is another fragmentary sectional view of the invention.

Referring to FIGS. 2 through 5, for assembly of the invention, clamp the fan body 1 from the peripheral rim with the first plate 23 and the second plate 24 of the folding plate 2, and insert the coupling blade 11 into the coupling holes 20 and 200 to form a movable fastening (as shown in FIG. 4). Then insert the latch stem 21 from one side of the fan body 1 into the latch member 22 on the other side of the fan body 1 to form a cross engagement (as shown in FIG. 5). The assembly thus formed may be disassembled and separated to become two independent items again whenever desired.

Figure 6:
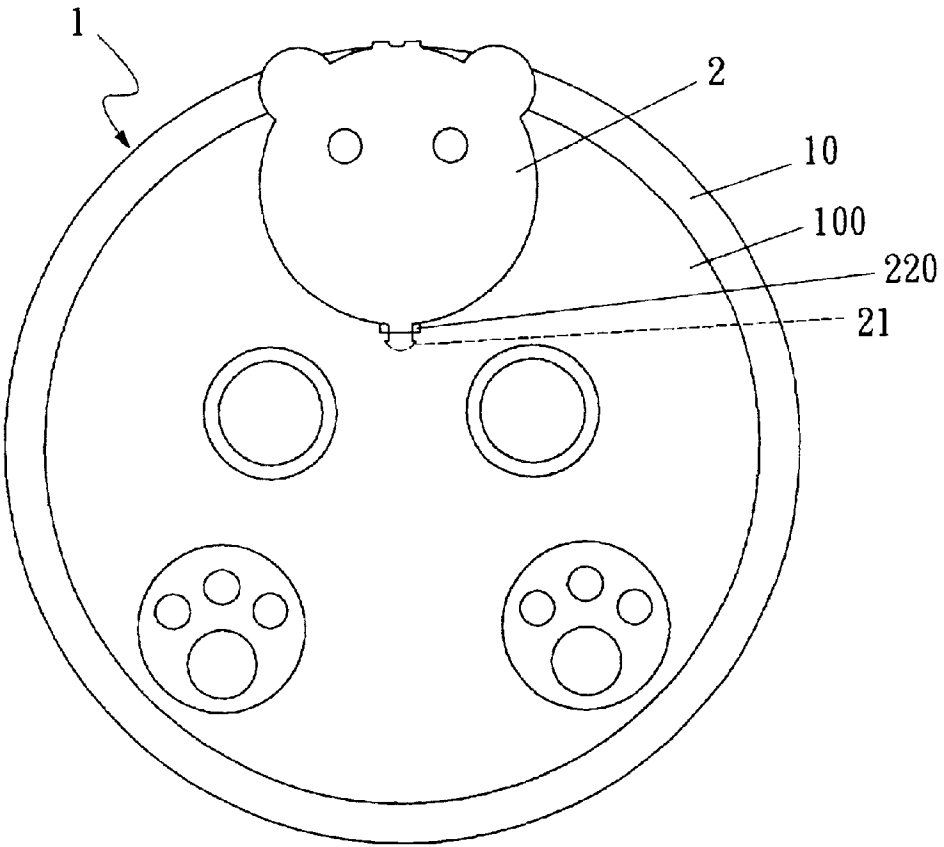
FIG. 6 is a top view of a design profile of the invention.

Referring to FIG. 6, the folding plate 2 may be formed with a selected profile to mate with the pattern of the fan body 1 (such as a bear head shown in the drawing). Moreover, the diameter of the one plate (23 or 24) coincides with the distance between the anchor hole 12 and the tangent side; of the perimeter so that the fan body 1 may be folded and encased within the folding plate 2 for storing.

Figure 8:
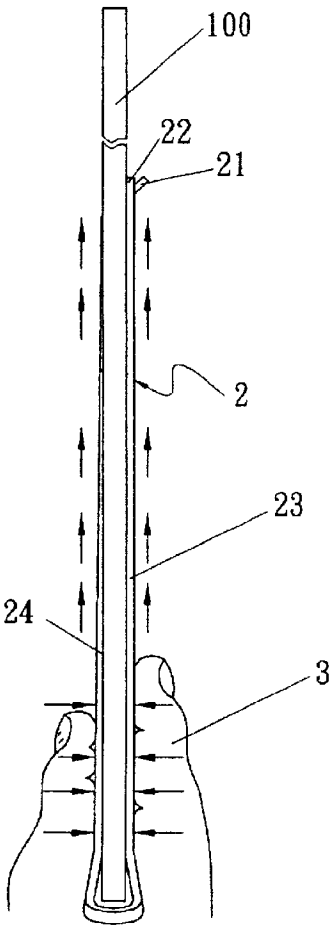
FIG. 8 is a schematic view of the invention in a use condition −1.
Figure 7:
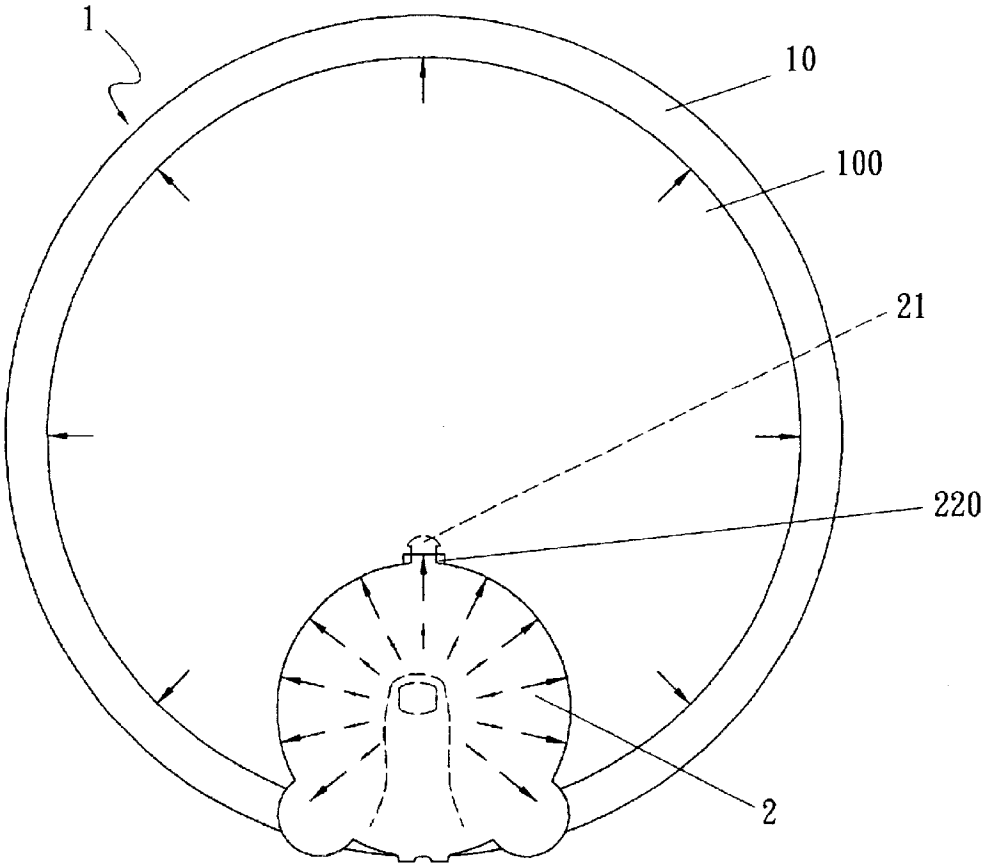
FIG. 7 is a schematic top view of the invention showing force distribution.
Figure 10:
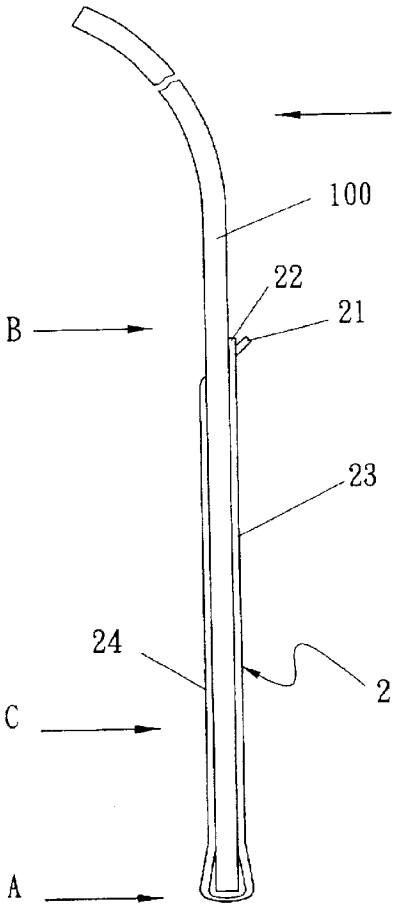
FIG. 10 is a schematic view of the invention in a use condition −3.
Figure 9:
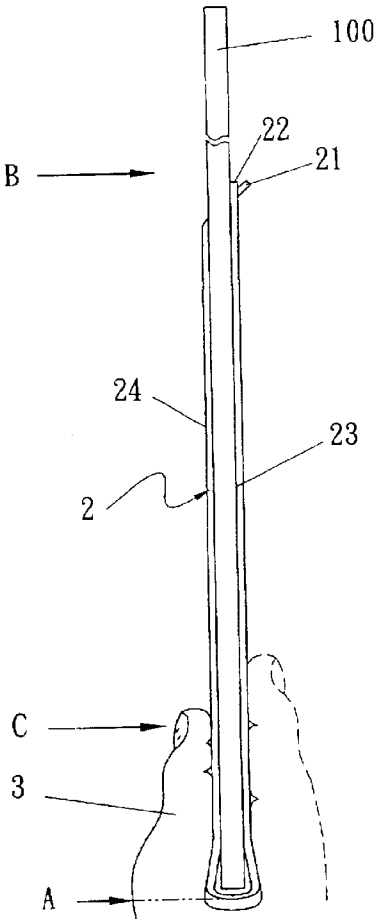
FIG. 9 is a schematic view of the invention in a use condition −2.
Figure 12:
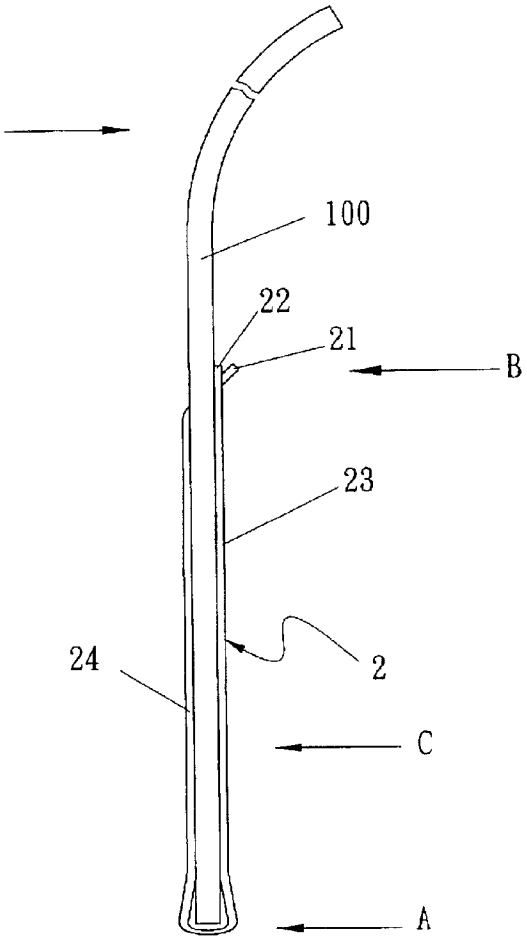
FIG. 12 is a schematic view of the invention in a use condition −5.
Figure 11:
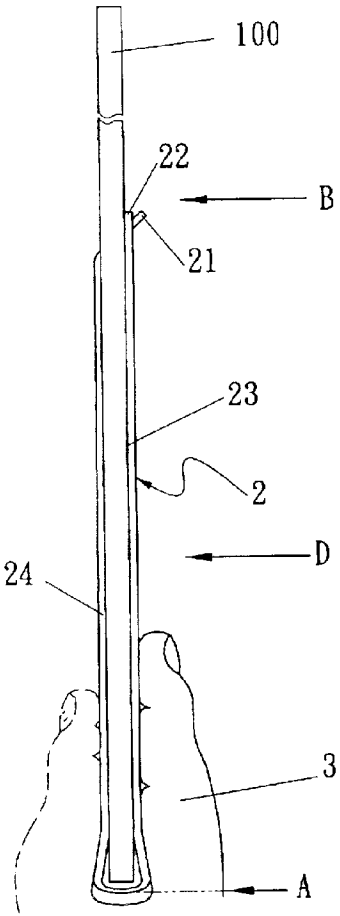
FIG. 11 is a schematic view of the invention in a use condition −4.

Referring to FIGS. 7 and 8, when the hand 3 clamps two sides of the folding plate 2, the entire folding plate 2 is flattened and in contact with the surface of the fan body 1. The force applying on point A is expanded to area B to become a forcing surface (as shown in FIGS. 9 and 10). When the hand waves the fan on the thrust locations C and D, the fan body is bent from the bordering rim to where the fan body is clamped by the folding plate 2 due to resistant force, thus the left and right fanning motions of the fan body can generate more airflow (referring to FIGS. 11 and 12).

Figure 13:
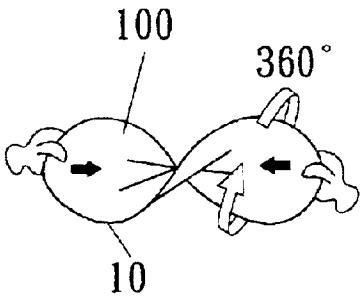
FIG. 13 is a schematic view of the invention showing the fan body being twisted.
Figure 14:
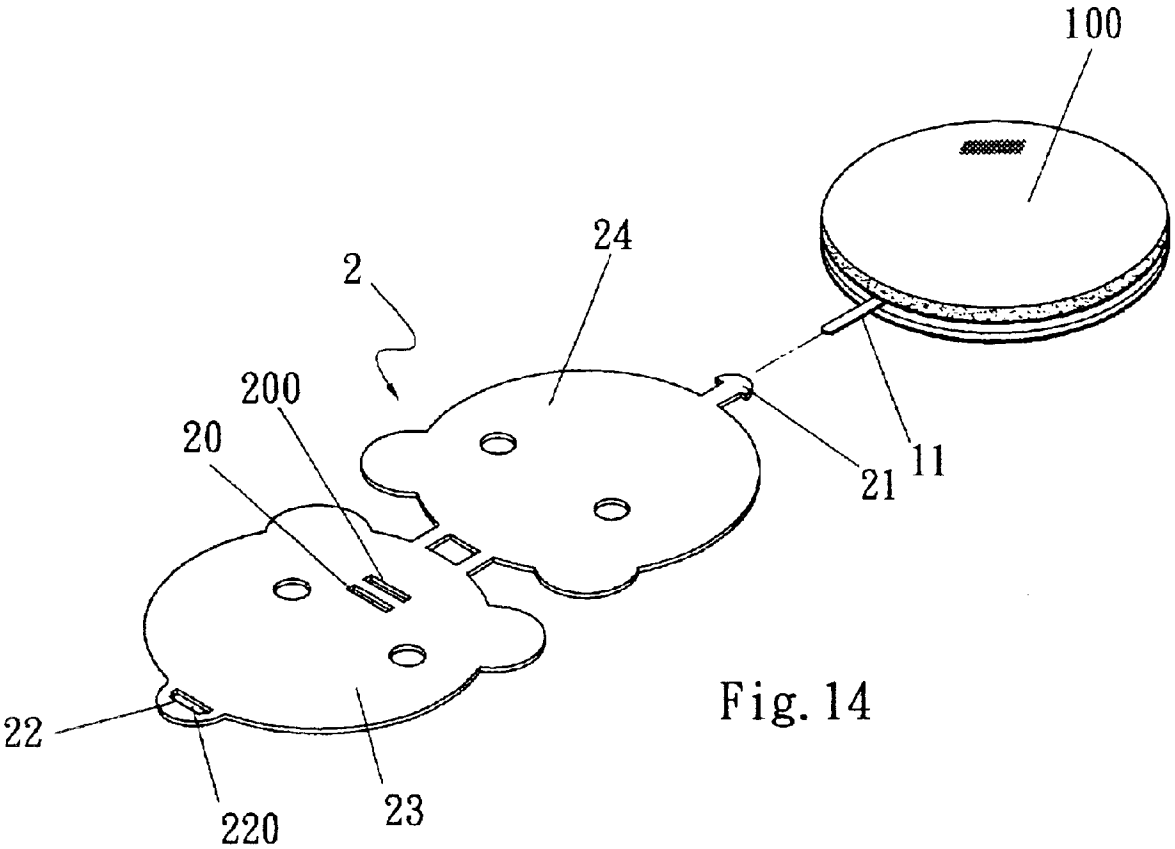
FIG. 14 is a schematic exploded view of the invention for folding.
Figure 16:
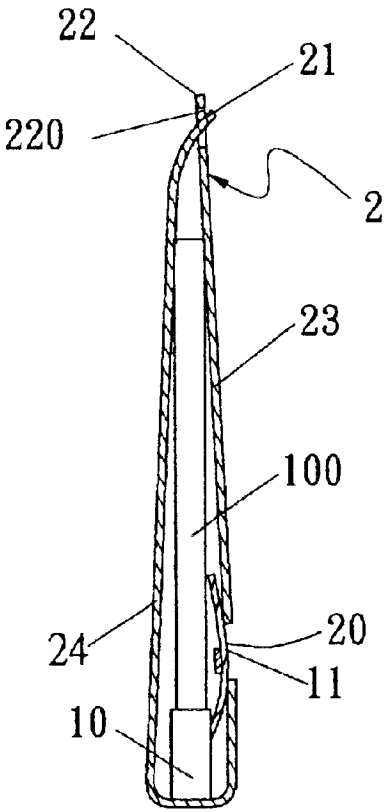
FIG. 16 is a sectional view of the invention after being folded.
Figure 15:
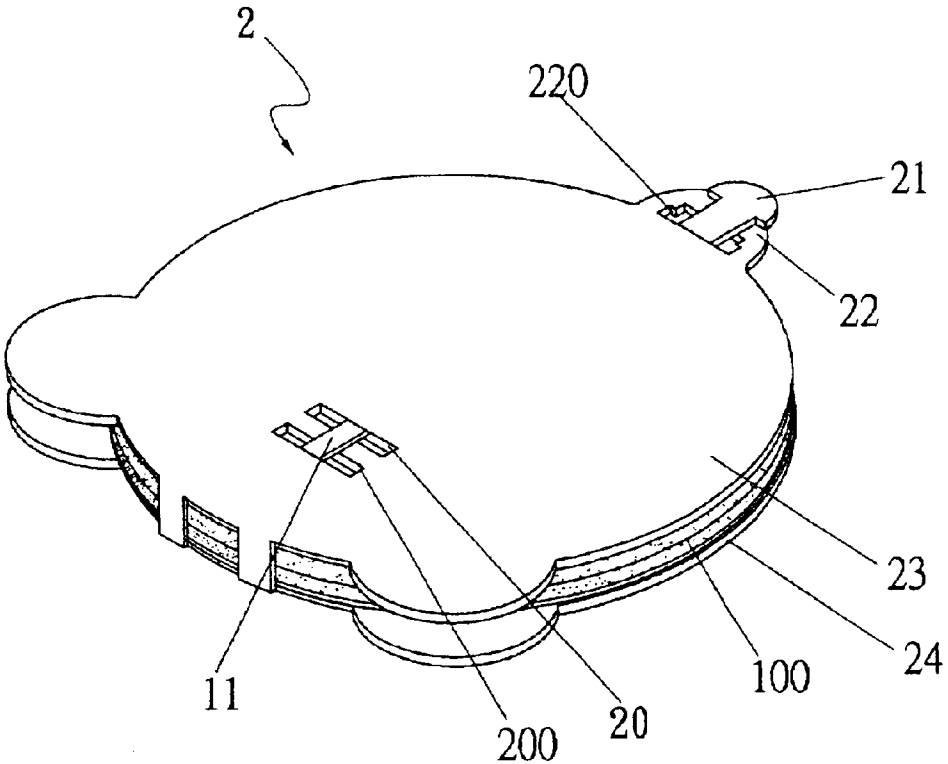
FIG. 15 is a schematic view of the invention after being folded.

When the fan is not in use in the extending form, the flexible strip 10 may be twisted to shrink the size of the fan body 1 (as shown in FIG. 13). Then the shrunk fan body 1 may be encased within the folded folding plate 2 with the coupling blade 11 latching on the coupling hole 20 to form a storing condition (as shown in FIGS. 14, 15 and 16).

Figure 17:
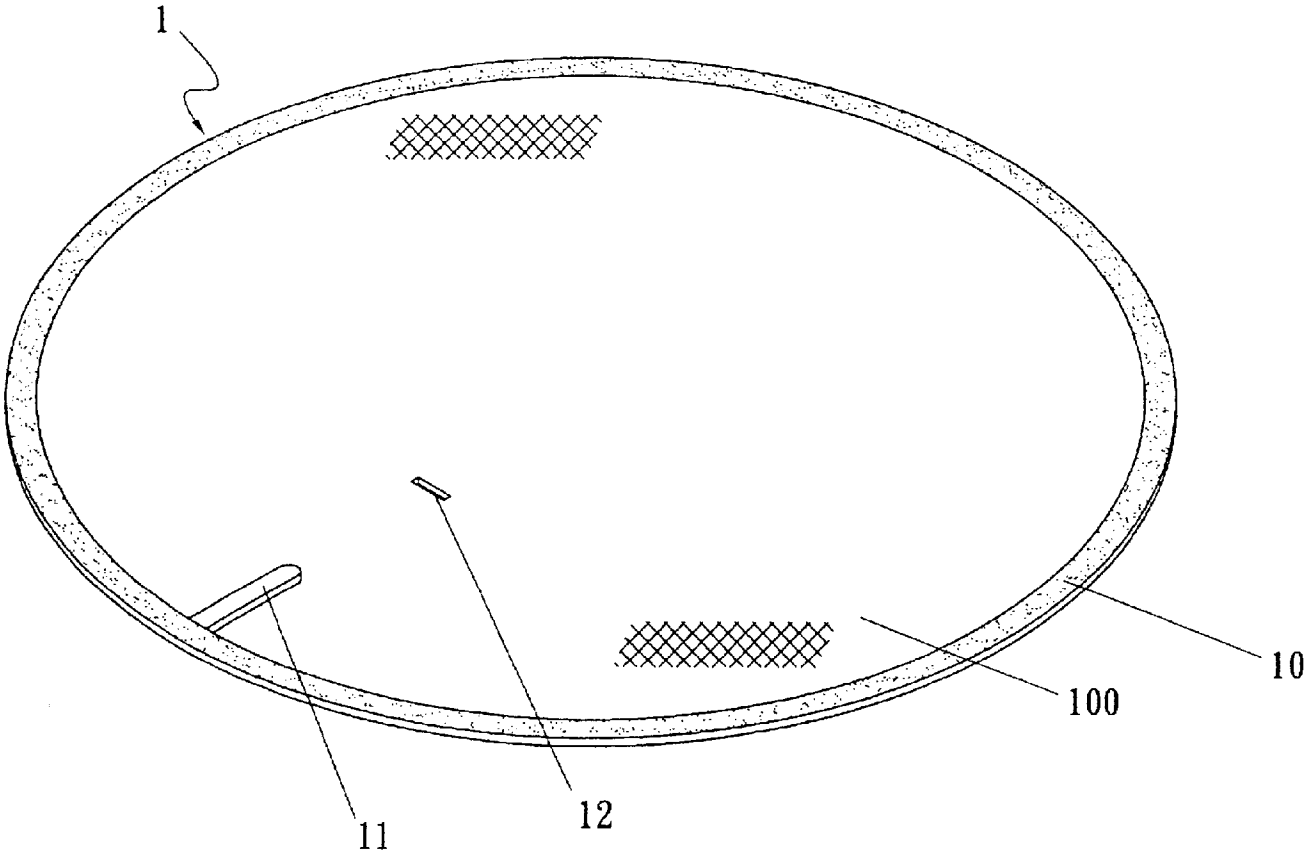
FIG. 17 is a schematic view of the invention for use as a flying disc.

In addition, as the fan body 1 and the folding plate 2 are fastened in a semi-fixing manner, they may be separated to become two independent items. Then the fan body 1 may be used as a Frisbee™ for recreational purpose (as shown in FIG. 17).

Figure 18:
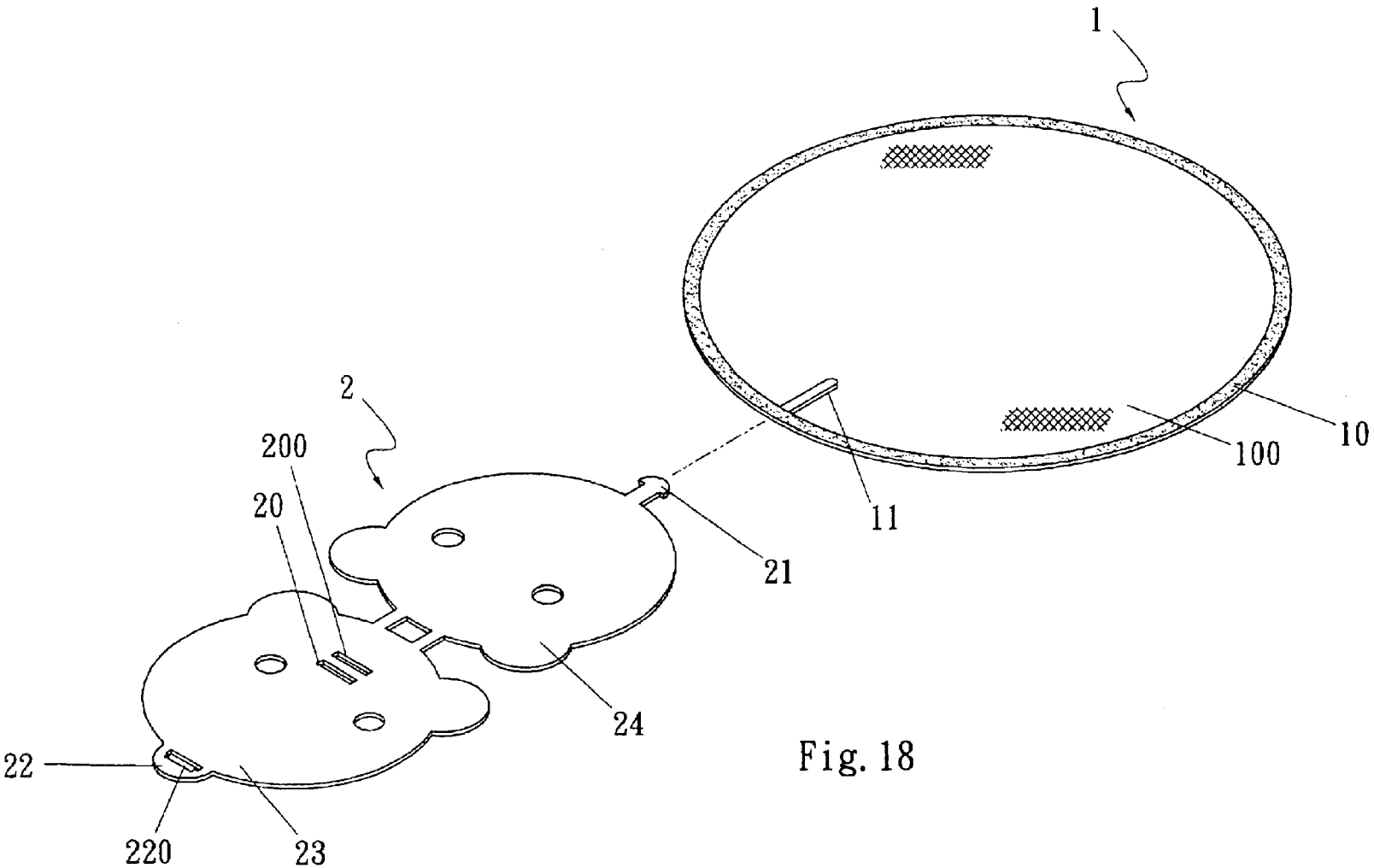
FIG. 18 is an exploded view of another embodiment of the invention.
Figure 19:
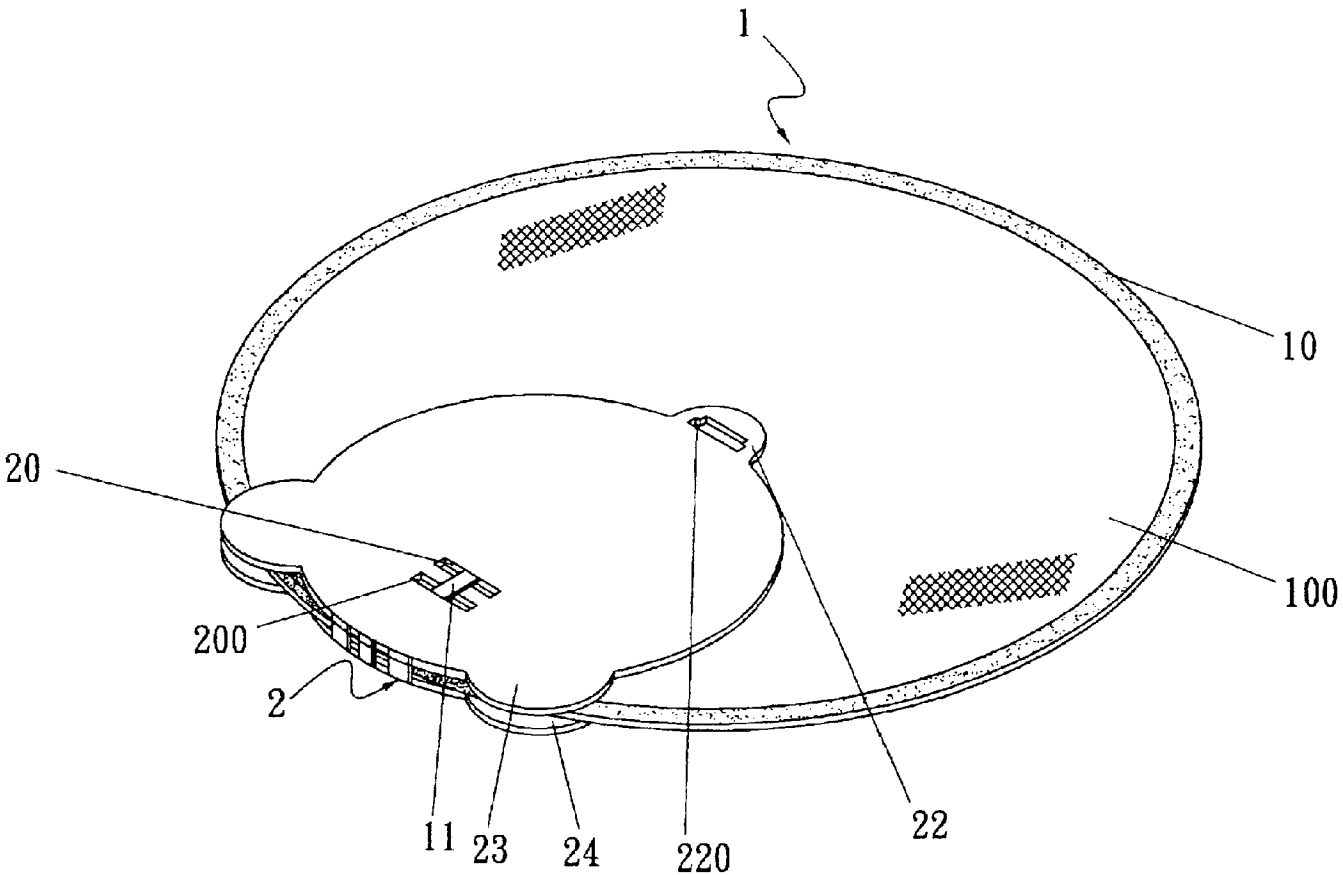
FIG. 19 is a perspective view of the second embodiment of the invention seen in FIG. 18.

FIGS. 18 and 19 illustrate another embodiment of the invention. The fan body 1 has a flat surface. And a coupling blade 11 is provided to engage with the folding plate 2 to generate desired fan functions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fan, comprising:

a fan body made from a fabric bordered by a flexible strip on a peripheral rim thereof, the fan body further having a coupling blade extending inwardly from the peripheral rim; and a foldable plate having a first and second section, the first and second section being a same size and the first section being connected to the second section, the first section having a latch member located on a top end thereof, the second section having a latch stem located on a top end thereof, the foldable plate detachably holding the fan body when the fan body is clamped between the first and second sections, the fan body being readily removable from the foldable plate to become a flying disc for recreational use.

2. The fan of claim 1, wherein the fabric of the fan body has an anchor hole formed therein.

3. The fan of claim 2, wherein the latch stem passes through the anchor hole when the foldable plate is holding the fan body.

4. The fan of claim 3, wherein the coupling blade attaches to the foldable plate when the foldable pate is holding the fan body.

5. The fan of claim 4, wherein a majority of the foldable plate is contained within the peripheral rim of the fan body when the foldable plate is in a use position holding the fan body.

6. The fan of claim 1, wherein the fabric is a flat surface without an opening for the foldable plate therein.

7. The fan of claim 1, wherein the latch member has at least one latch hole for receiving the latch stem.

8. The fan of claim 1, wherein the latch stem has an end with a greater width than a mid-portion thereof.

9. The fan of claim 1, wherein the latch stem is movably engageable with the fan surface.

10. The fan of claim 1, wherein the fabric is printed with a selected pattern.

11. The fan of claim 1, wherein a majority of the foldable plate is contained within the peripheral rim of the fan body when the foldable plate is holding the fan body.

12. The fan of claim 1, wherein the coupling blade attaches to the foldable plate when the foldable plate is holding the fan body.

13. The fan of claim 1, wherein one side of the fan body is foldable 360° relative to an opposed side so that the fan can be twisted and folded onto itself from a flat position to a twisted position, the fan body will have a circular shape in both the flat position and the twisted position.

* * * * *